US008593045B2

(12) United States Patent
Yoshimoto et al.

(10) Patent No.: US 8,593,045 B2
(45) Date of Patent: Nov. 26, 2013

(54) SPARK PLUG

(75) Inventors: Osamu Yoshimoto, Inazawa (JP); Tomo-o Tanaka, Kitanagoya (JP); Takehito Kuno, Nagoya (JP)

(73) Assignee: NGK Spark Plug Co., Ltd. (JP)

( * ) Notice: Subject to any disclaimer, the term of this patent is extended or adjusted under 35 U.S.C. 154(b) by 0 days.

(21) Appl. No.: 13/700,742

(22) PCT Filed: May 26, 2011

(86) PCT No.: PCT/JP2011/002950

§ 371 (c)(1), (2), (4) Date: Nov. 29, 2012

(87) PCT Pub. No.: WO2011/152004

PCT Pub. Date: Dec. 8, 2011

(65) Prior Publication Data

US 2013/0088139 A1 Apr. 11, 2013

(30) Foreign Application Priority Data

Jun. 2, 2010 (JP) ..... 2010-126554

(51) Int. Cl.
*H01T 13/20* (2006.01)

(52) U.S. Cl.
USPC ..... 313/141

(58) Field of Classification Search
USPC ..... 313/141
See application file for complete search history.

(56) References Cited

U.S. PATENT DOCUMENTS

| | | | | |
|---|---|---|---|---|
| 4,540,910 | A | 9/1985 | Kondo et al. | 313/11.5 |
| 6,533,628 | B1 | 3/2003 | Matsutani | 445/7 |
| 6,603,244 | B2 | 8/2003 | Sugiyama et al. | 313/118 |
| 6,794,803 | B2 | 9/2004 | Hori et al. | 313/141 |
| 6,831,397 | B2 | 12/2004 | Kanao et al. | 313/141 |
| 6,885,135 | B2 | 4/2005 | Kanao et al. | 313/141 |
| 7,823,556 | B2 | 11/2010 | Lykowski et al. | 123/169 EL |
| 8,044,562 | B2 | 10/2011 | Musasa et al. | 313/141 |
| 8,207,657 | B2 | 6/2012 | Suzuki et al. | 313/141 |
| 2008/0206089 | A1 | 8/2008 | Norling | 420/443 |
| 2011/0259875 | A1 | 10/2011 | Norling | 219/553 |

FOREIGN PATENT DOCUMENTS

| | | | |
|---|---|---|---|
| CN | 101501229 | 8/2009 | H01T 13/20 |
| JP | 59-94391 | 9/1984 | H01T 13/20 |
| JP | 59-169087 | 9/1984 | H01T 13/20 |
| JP | 2001-15245 | 1/2001 | H01T 13/20 |
| JP | 2002-235139 | 8/2002 | C22C 19/05 |
| JP | 2002-260818 | 9/2002 | H01T 13/39 |
| JP | 2002-313524 | 10/2002 | H01T 13/32 |
| JP | 2003-197347 | 7/2003 | H01T 13/39 |
| JP | 2002-343533 | 11/2003 | H01T 13/39 |
| JP | 2006-173141 | 6/2006 | C22C 19/05 |
| JP | 2009-500521 | 1/2009 | C22C 19/05 |
| JP | 2010-108939 | 5/2010 | C22C 19/03 |
| JP | 2012-015126 | 1/2012 | H01T 13/20 |
| WO | WO 2009/063914 | 5/2009 | H01T 13/32 |
| WO | WO 2010/053099 | 5/2010 | H01T 13/20 |

OTHER PUBLICATIONS

Form PCT/ISA/210—Int'l Search Report (from corresponding Int'l Patent App. No. PCT/JP2011/002950—English version only); 2 pages.

Chinese Office Action from corresponding CN App. No. 201180027433, issued on Jul. 24, 2013 (with translation); 16 pages.

*Primary Examiner* — Donald Raleigh
(74) *Attorney, Agent, or Firm* — Kusner & Jaffe

(57) ABSTRACT

A spark plug which exhibits improved resistance to high-temperature oxidation of an electrode, and improved resistance to spark-induced erosion of, improved resistance to oxidation of, and improved joining reliability of a tip joined to the electrode. A spark plug has spark members; each of the spark members has a weight of 1.5 mg or more; and a center electrode and a ground electrode contain Ni as a main component, C in an amount of 0.005% by mass to 0.10% by mass, Si in an amount of 1.05% by mass to 3.0% by mass, Mn in an amount of 2.0% by mass or less, Cr in an amount of 20% by mass to 32% by mass, and Fe in an amount of 6% by mass to 16% by mass.

7 Claims, 2 Drawing Sheets

SPARK PLUG

FIELD OF THE INVENTION

The present invention relates to a spark plug for use in an internal combustion engine, etc., and particularly to a spark plug in which a noble metal tip is provided at an end portion of an electrode.

BACKGROUND OF THE INVENTION

A spark plug includes a center electrode disposed along the axis thereof and a ground electrode disposed with a gap formed between the ground electrode and a forward end portion of the center electrode, and ignites an air-fuel mixture introduced into a combustion chamber of an internal combustion engine, etc., through generation of spark discharges between the electrodes. Since electrodes used in a spark plug have concern for not only erosion stemming from spark discharges, but also erosion stemming from oxidation or the like caused by exposure to combustion gas, electrode materials having excellent durability have conventionally been developed (refer to, for example, Japanese Patent Application Laid-Open (kokai) No. 2002-260818).

Meanwhile, there exists a spark plug in which, in order to cope with erosion of electrodes stemming from spark discharges, noble metal tips are joined to respective end portions of the electrodes between which spark discharges are generated, thereby exhibiting excellent resistance to spark-induced erosion (refer to, for example, Japanese Patent Application Laid-Open (kokai) No. 2003-197347). Furthermore, there exists a spark plug in which a noble metal tip is joined to an end of an electrode and in which a relatively small size is imparted to the noble metal tip for improving ignition performance (refer to, for example, Japanese Patent Application Laid-Open (kokai) No. 2002-313524).

Incidentally, in association with tendency toward higher outputs, etc., of engines, the environment in which spark plugs are used is becoming more severe. Accordingly, further improvement of durability is required of electrodes of spark plugs. Conventionally, in order to meet the requirement, NCF600, NCF601, etc., have been used as electrode materials.

Upon exposure to a high-temperature atmosphere, an Ni alloy which contains Al, such as INCONEL (registered trademark) 601, forms an Al oxide layer on its surface, thereby restraining oxidation-induced erosion of an electrode material and thus securing resistance to high-temperature oxidation. However, the following has been found: since Al is highly reactive with nitrogen, Al and nitrogen react with each other to deposit Al nitride. As a result, Al nitride is formed as lumps in a region located internally of the Al oxide layer. Al nitride is hard, and a region dotted with Al nitride is embrittled. The higher the temperature and the longer the high-temperature retention, the more deeply such Al nitride deposits in the electrode material. Accordingly, in the case of a thin electrode material, Al nitride may deposit across the entire thickness.

Also, the following has been found: when an electrode to which a noble metal tip is joined is exposed to a high-temperature atmosphere, electrode material components partially diffuse into the noble metal tip and react with a noble metal, thereby forming a low-melting-point compound. Formation of such a low-melting-point compound leads to deterioration in resistance to spark-induced erosion and resistance to oxidation of the noble metal tip, and leads further to deterioration in reliability of joining the noble metal tip to the electrode.

SUMMARY OF THE INVENTION

The present invention has been conceived in view of the above circumstances. An advantage of the invention is a spark plug which exhibits improved resistance to high-temperature oxidation of an electrode without Al being positively contained, and improved resistance to spark-induced erosion of a noble metal tip joined to an electrode, improved resistance to oxidation of, and improved joining reliability of a noble metal tip joined to the electrode.

In accordance with the present invention, there is provided a spark plug according to claim 1 comprised of a center electrode extending in an axial direction; a ceramic insulator surrounding a radial circumference of the center electrode; a metallic shell surrounding a radial circumference of the ceramic insulator and holding the ceramic insulator; and a ground electrode which is bent such that one end portion thereof forms a gap with a forward end portion of the center electrode. The other end portion of the ground electrode is joined to the metallic shell. A small spark member which contains a noble metal as a main component is provided on at least one of the center electrode and the ground electrode at a position which faces the gap. The spark plug is characterized in that the spark member has a weight of 1.5 mg or more and that the center electrode or the ground electrode on which the spark member is provided contains Ni as a main component, C in an amount of 0.005% by mass to 0.1% by mass, Si in an amount of 1.05% by mass to 3% by mass, Mn in an amount of 2% by mass or less, Cr in an amount of 20% by mass to 32% by mass, and Fe in an amount of 6% by mass to 16% by mass.

According to the above spark plug, the center electrode or the ground electrode having a small piece of the spark member which contains a noble metal as a main component contains C in an amount of 0.005% by mass to 0.1% by mass. C combines with Cr, etc., to form carbide, and yields, at a temperature near a solid solution formation temperature, the effect of improving resistance to high-temperature oxidation through prevention of coarsening of crystal grains. In order to yield the effect, C must be contained in an amount of 0.005% by mass or more. By means of C being contained, the effect of strengthening grain boundaries is also yielded. Meanwhile, when the C content is in excess of 0.1% by mass, Cr in the matrix is excessively consumed, thereby deteriorating resistance to high-temperature oxidation. Therefore, the C content is specified as 0.10% by mass or less. When the C content is in excess of 0.1% by mass, workability may deteriorate.

Additionally, the electrode on which the spark member is provided contains Si in an amount of 1.05% by mass to 3% by mass. In the present invention, in order to improve resistance to high-temperature oxidation, in place of Al, Si is contained. Si yields the effect of improving resistance to high-temperature oxidation through formation of Si oxide on the surface of the electrode. In order to yield the effect, Si must be contained in an amount of 1.05% by mass or more. Preferably, in order to further improve resistance to high-temperature oxidation, Si is contained in an amount of 1.2% by mass or more. Meanwhile, since Si oxide is very low in thermal expansion coefficient as compared with the electrode which contains Ni as a main component, upon exposure to heating and cooling cycles in a state in which Si oxide is generated in a large amount, Si oxide exfoliates from the surface of the electrode; thus, resistance to high-temperature oxidation deteriorates.

Therefore, the Si content is specified as 3% by mass or less. Also, when the Si content is in excess of 3% by mass, workability may deteriorate.

Also, Si elements diffuse at relatively high speed in an Ni matrix, Ni being a main component of the electrode. Thus, when the electrode on which the spark member is provided is exposed to a high-temperature atmosphere, Si contained in the electrode diffuses into the spark member, and a low-melting-point compound of Si with a noble metal is formed. When the low-melting-point compound is formed in a large amount, resistance to spark-induced erosion of and resistance to oxidation of the spark member deteriorate, and joining reliability deteriorates due to separation of the spark member; therefore, the Si content must be 3% by mass or less.

Additionally, the electrode on which the spark member is provided contains Mn in an amount of 2% by mass or less (including 0% by mass). Since Mn is a useful deoxidizing element, addition of Mn is preferred in formation of an electrode material. However, when Mn is contained in a large amount, resistance to high-temperature oxidation deteriorates; therefore, the Mn content must be 2% by mass or less. Also, when the Mn content is in excess of 2% by mass, workability may deteriorate.

Additionally, the electrode on which the spark member is provided contains Cr in an amount of 20% by mass to 32% by mass. Cr is an essential element for imparting resistance to high-temperature oxidation to the electrode through formation of $Cr_2O_3$ on the surface of the electrode at high temperature. In order to yield the effect, Cr must be contained in an amount of 20% by mass or more. Meanwhile, when the Cr content is in excess of 32% by mass, the γ' phase is markedly formed, resulting in deterioration in resistance to high-temperature oxidation; therefore, the Cr content must be 32% by mass or less. Also, when the Cr content is in excess of 32% by mass, workability and toughness may deteriorate. In view of improvement of resistance to high-temperature oxidation, the Cr content is preferably 20% by mass to 27% by mass, more preferably 22% by mass to 27% by mass.

Additionally, the electrode on which the spark member is provided contains Fe in an amount of 6% by mass to 16% by mass. Through employment of an Fe content of 6% by mass or more, resistance to high-temperature oxidation improves, as will be apparent from the test results to be described later. Also, containing Fe yields the effect of lowering the hardness of the electrode after solution heat treatment and the effect of improving workability. Meanwhile, when Fe is contained excessively, not only does resistance to high-temperature oxidation deteriorate, but also the σ phase, which is a brittle phase, is apt to be deposited. Therefore, the Fe content must be 16% by mass or less.

Additionally, the weight of the spark member is specified as 1.5 mg or more. As mentioned above, Si contained in the electrode is apt to diffuse, and there is formed a low-melting-point compound of Si with a noble metal used to form the spark member. When the ratio of the formed low-melting-point compound to the entire spark member increases, resistance to spark-induced erosion and resistance to oxidation of the spark member deteriorate, and joining reliability deteriorates due to separation of the spark member. Therefore, by means of the spark member assuming a relatively large size; specifically, a weight of 1.5 mg or more, even when a low-melting-point compound is formed through diffusion of Si, influence thereof can be reduced to the greatest possible extent. Accordingly, there can be enhanced resistance to spark-induced erosion and resistance to oxidation of the spark member and reliability of joining the spark member to the electrode.

In the present invention, the main component means a component having the highest mass ratio in the electrode.

In accordance with another aspect of the present invention, there is provided a spark plug according to claim 2 wherein the electrode on which the spark member is provided contains Si in an amount of 1.4% by mass or less.

In accordance with another aspect of the present invention, there is provided a spark plug according to claim 3 wherein the electrode on which the spark member is provided contains at least one of Zr, Y, and REM in a total amount of 0.01% by mass to 0.5% by mass.

In accordance with another aspect of the present invention, there is provided a spark plug according to claim 4 wherein the electrode on which the spark member is provided contains Al in an amount of 0.1% by mass to 2% by mass.

In accordance with yet another aspect of the present invention, there is provided a spark plug according to claim 5 wherein the electrode on which the spark member is provided contains at least one of Ti, Nb, and Cu in a total amount of 0.1% by mass to 2% by mass.

In accordance with still another aspect of the present invention, there is provided a spark plug according to claim 6 wherein the other end portion of the ground electrode is joined to a forward end surface of the metallic shell and that a relational expression $1.5 \leq L/S \leq 8.5$ is satisfied, where L is a length of the ground electrode as measured from the other end portion to the one end portion along an extending direction of the ground electrode, and S is an area of a cross section of the ground electrode taken perpendicularly to the extending direction.

According to a conceivable measure to improve ignition performance, the ground electrode has a relatively long length while having a relatively small cross-sectional area; however, resistance to breakage of the ground electrode due to vibration of an engine may deteriorate. Additionally, in the case where the spark member is provided on the ground electrode, since the spark member has a large weight and is provided at one end portion of the ground electrode, there increases the distance of the center of gravity of the entire ground electrode from the other end portion of the ground electrode which is fixed to the metallic shell. Accordingly, a dynamic moment at a bent portion of the ground electrode increases; i.e., load imposed on the bent portion of the ground electrode increases, and as a result, resistance to breakage of the ground electrode deteriorates more markedly. Also, as a result of reduction in the cross-sectional area of the ground electrode, difficulty is encountered in transmitting heat received by the ground electrode to the metallic shell, and thus the ground electrode is likely to have a higher temperature; therefore, resistance to high-temperature oxidation is required.

Preferably, the cross-sectional area S of the ground electrode is 2 $mm^2$ or more for ensuring weldability with the metallic shell, and 5 $mm^2$ or less for ensuring ignition performance. Also, preferably, the length L of the ground electrode from one end portion to the other end portion is 6 mm or more for ensuring bending workability of the ground electrode, and 20 mm or less for avoiding interference with other component parts of an internal combustion engine when the spark plug is to be mounted to the internal combustion engine. In the case where the cross-sectional area S of the ground electrode differs along the extending direction of the ground electrode, the cross-sectional area S is the average of cross-sectional areas measured at different positions along the extending direction (for example, the average of cross-sectional areas measured at 10 equally-spaced positions along the extending direction of the ground electrode). Also, the length L of the ground electrode from one end portion to the other end portion is the arithmetic mean of a length L1 and a length L2 (L1+L2)/2), where L1 is the length as measured from the one end portion to the other end portion along a side surface of the ground electrode which faces the center electrode, and L2 is the length as measured from the one end portion to the other end portion along a side surface of the ground electrode located opposite the side surface which faces the center electrode.

In accordance with yet another aspect of the present invention, there is provided a spark plug according to claim 7 as described above, wherein a conical portion is formed at the forward end portion of the center electrode; the spark member is provided at a tip of the conical portion; and the conical portion of the center electrode has a volume of 0.2 $mm^3$ to 2.5 $mm^3$.

The conical portion is adapted to transmit heat received by the spark member to the center electrode, and, the greater the volume of the conical portion, the greater the resistance to spark-induced erosion of the spark member. Meanwhile, when the volume of the conical portion is excessively large, thermal stress stemming from difference in thermal expansion coefficient between the spark member and the conical portion causes the occurrence of cracking in the joining interface between the spark member and the conical portion. As a result, resistance to spark-induced erosion of the spark member may deteriorate due to deterioration in heat transfer from the spark member.

According to the spark plug of claim 1, while resistance to oxidation of the electrode is improved, there can be improved resistance to spark-induced erosion of, resistance to oxidation of, and joining reliability of the spark member provided on the electrode.

According to the spark plug of claim 2, the electrode on which the spark member is provided contains Si in an amount of 1.4% by mass or less. Thus, Si contained in the electrode can be reduced in the amount of diffusion into the spark member, whereby there can be restrained formation of a low-melting-point compound of Si with a noble metal. Therefore, resistance to spark-induced erosion of the spark member can be further enhanced.

According to the spark plug of claim 3, the electrode on which the spark member is provided contains at least one of Zr, Y, and REM in a total amount of 0.01% by mass to 0.5% by mass. Zr, Y, and REM have the effect of improving resistance to high-temperature oxidation through restraint of exfoliation of Si oxide. In order to yield the effect, at least one of Zr, Y, and REM must be contained in a total amount of 0.01% by mass or more. Also, containing Zr, Y, and REM singly or in combination improves workability and furthermore yields the effect of strengthening grain boundaries. However, when Zr, Y, and REM are contained in excess singly or in combination, hot workability may deteriorate. Therefore, the total content of at least one of Zr, Y, and REM is specified as 0.5% by mass or less.

Al is an effective element for improving resistance to high-temperature oxidation; however, as mentioned above, the electrode may be embrittled through formation of an Al nitride. However, the following has been found: by means of the electrode containing Al together with a predetermined amount of Si, the formation of an Al nitride can be restrained by the presence of Si, whereby only the effect of improving resistance to high-temperature oxidation, the effect being yielded through presence of Al, can be exhibited. However, when Al is contained excessively, the effect of restraining the formation of Al nitride, the effect being yielded through presence of Si, fails to be yielded. Therefore, according to the spark plug of claim 4, the electrode material contains Al in an amount of 0.1% by mass to 2% by mass while containing Si in a predetermined amount, whereby resistance to high-temperature oxidation and resistance to high-temperature nitridation can be compatibly attained.

According to the spark plug of claim 5, the electrode on which the spark member is provided contains at least one of Ti, Nb, and Cu in a total amount of 0.1% by mass to 2% by mass. Ti, Nb, and Cu have the effect of improving resistance to high-temperature oxidation through restraint of exfoliation of Si oxide. In order to yield the effect, at least one of Ti, Nb, and Cu must be contained in a total amount of 0.1% by mass or more. Meanwhile, when Ti, Nb, and Cu are contained in excess singly or in combination, workability may deteriorate. Therefore, the total content of at least one of Ti, Nb, and Cu is specified as 2% by mass or less.

According to the spark plug of claim 6, since an electrode material which contains the above-mentioned components is used to form the electrode, even though the relational expression $1.5 \leq L/S \leq 8.5$ is satisfied, where L is the length of the ground electrode as measured from one end portion to the other end portion along the extending direction of the ground electrode, and S is the area of a cross section of the ground electrode taken perpendicularly to the extending direction; i.e., even though the ground electrode is relatively thin and long, resistance to high-temperature oxidation can be ensured. Therefore, the spark plug can exhibit excellent resistance to breakage.

According to the spark plug of claim 7, the volume of the conical portion of the center electrode is specified as 2.5 $mm^3$ or less. By virtue of this, the occurrence of cracking in the joining interface between the spark member and the conical portion can be restrained. Therefore, heat transfer from the spark member can be ensured, and, in turn, resistance to spark-induced erosion of the spark member can be ensured. Also, since the center electrode is formed from an electrode material which contains the above-mentioned components, even though the conical portion has a relatively small volume of 0.2 $mm^3$, resistance to high-temperature oxidation of the conical portion can be ensured, and there can be ensured heat transfer from the spark member and, in turn, resistance to spark-induced erosion of the spark member.

BRIEF DESCRIPTION OF THE DRAWINGS

An embodiment of the present invention will next be described with reference to the drawings. FIG. 1 is a partially cutaway front view showing a spark plug 1. In the following description, the direction of an axis CL1 of the spark plug 1 in FIG. 1 is referred to as the vertical direction, and the lower side of the spark plug 1 in FIG. 1 is referred to as the forward side of the spark plug 1, and the upper side as the rear side of the spark plug 1.

Figure 1:
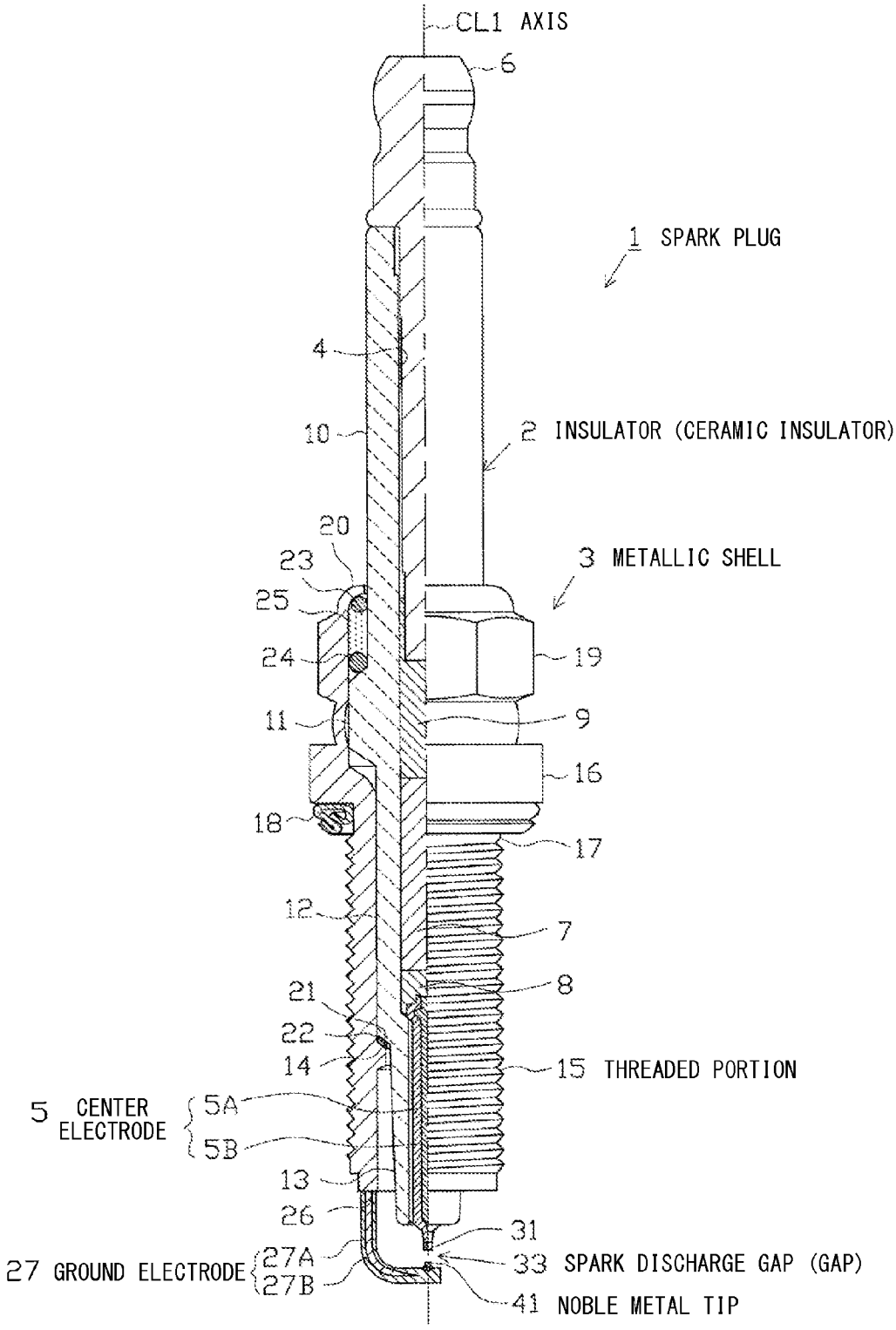
FIG. 1 is a partially-cutaway front view showing the configuration of a spark plug according to an embodiment of the present invention.

The spark plug 1 includes a ceramic insulator 2, which corresponds to the tubular insulator in the present invention, and a tubular metallic shell 3, which holds the ceramic insulator 2.

The ceramic insulator 2 is formed from alumina or the like by firing, as well known in the art. The ceramic insulator 2 externally includes a rear trunk portion 10 formed on the rear side. A large-diameter portion 11 is located forward of the rear trunk portion 10 and projects radially outward. An intermediate trunk portion 12 is located forward of the large-diameter portion 11 and is smaller in diameter than the large-diameter portion 11. A leg portion 13 is located forward of the intermediate trunk portion 12 and is smaller in diameter than the intermediate trunk portion 12. Additionally, the large-diameter portion 11, the intermediate trunk portion 12, and most of the leg portion 13 of the ceramic insulator 2 are accommodated in the metallic shell 3. A tapered, stepped portion 14 is formed at a connection portion between the leg portion 13 and the intermediate trunk portion 12. The ceramic insulator 2 is seated on the metallic shell 3 via the stepped portion 14.

Furthermore, the ceramic insulator 2 has an axial bore 4 extending therethrough along the axis CL1. A center electrode 5 is fixedly inserted into a forward end portion of the axial bore 4. The center electrode 5 assumes a rodlike (circular columnar) shape as a whole and projects from the forward end of the ceramic insulator 2. Also, the center electrode 5 includes an outer layer 5B of an Ni alloy which contains nickel (Ni) as a main component, the Ni alloy being described later, and an inner layer 5A of copper, a copper alloy, or pure Ni, which is higher in thermal conductivity than the Ni alloy. Furthermore, the circular columnar center electrode 5 includes a body portion 34, whose outside diameter is substantially fixed, and a conical portion 32, which is located forward of the body portion 34, is smaller in diameter than the body portion 34, and tapers forward. A circular columnar noble metal member (spark member) 31 of a noble metal alloy (e.g., an iridium alloy) is joined to the forward end surface of the conical portion 32 via a fusion zone. The noble metal member 31 has a weight of 1.5 mg or more. Also, the conical portion 32 has a volume of 0.2 $mm^3$ to 2.5 $mm^3$. The volume of the conical portion 32 is the volume of a portion ranging from the rear end of the conical portion 32 (the boundary between the body portion and the conical portion 32 of the center electrode) to the rearmost end of the fusion zone where the conical portion 32 and the noble metal member 31 are fused together.

Also, a terminal electrode 6 is fixedly inserted into the rear side of the axial bore 4 in such a manner as to project from the rear end of the ceramic insulator 2.

Furthermore, a circular columnar resistor 7 is disposed within the axial bore 4 between the center electrode 5 and the terminal electrode 6. Opposite end portions of the resistor 7 are electrically connected to the center electrode 5 and the terminal electrode 6 via conductive glass seal layers 8 and 9, respectively.

Additionally, the metallic shell 3 is formed into a tubular shape from a low-carbon steel or the like and has a threaded portion (externally threaded portion) 15 on its outer circumferential surface. The threaded portion 15 is adapted to mount the spark plug 1 to a combustion apparatus, such as an internal combustion engine or a fuel cell reformer. Also, the metallic shell 3 has a seat portion 16 formed on its outer circumferential surface and located rearward of the threaded portion 15. A ring-like gasket 18 is fitted to a screw neck 17 located at the rear end of the threaded portion 15. Furthermore, the metallic shell 3 has a tool engagement portion 19 provided near its rear end. The tool engagement portion 19 has a hexagonal cross section and allows a tool such as a wrench to be engaged therewith when the spark plug 1 is to be mounted to the combustion apparatus. The metallic shell 3 has a crimp portion 20 provided at its rear end portion and adapted to hold the ceramic insulator 2. In the present embodiment, in order to reduce the size of the spark plug 1, the metallic shell 3 is reduced in size to have a relatively small diameter. As a result, the threaded portion 15 has a relatively small thread diameter (e.g., M10 or less).

The metallic shell 3 has a tapered, stepped portion 21 provided on its inner circumferential surface and adapted to allow the ceramic insulator 2 to be seated thereon. The ceramic insulator 2 is inserted forward into the metallic shell 3 from the rear end of the metallic shell 3, and, in a state in which the stepped portion 14 of the ceramic insulator 2 butts against the stepped portion 21 of the metallic shell 3, a rear-end opening portion of the metallic shell 3 is crimped radially inward; i.e., the crimp portion 20 is formed, whereby the ceramic insulator 2 is fixed in place. An annular sheet packing 22 intervenes between the stepped portions 14 and 21 of the ceramic insulator 2 and the metallic shell 3, respectively. This retains gastightness of a combustion chamber and prevents outward leakage of fuel gas through a clearance between the inner circumferential surface of the metallic shell 3 and the leg portion 13 of the ceramic insulator 2, the clearance being exposed to the combustion chamber.

Furthermore, in order to ensure gastightness which is established by crimping, annular ring members 23 and 24 intervene between the metallic shell 3 and the ceramic insulator 2 in a region near the rear end of the metallic shell 3, and a space between the ring members 23 and 24 is filled with a powder of talc 25. That is, the metallic shell 3 holds the ceramic insulator 2 via the sheet packing 22, the ring members 23 and 24, and the talc 25.

Also, a ground electrode 27 is joined to a forward end portion 26 of the metallic shell 3. The ground electrode 27 is bent at its substantially intermediate portion such that a side surface of its distal end portion faces a forward end portion of the center electrode 5. The ground electrode 27 has a 2-layer structure consisting of an outer layer 27A and an inner layer 27B. In the present embodiment, the outer layer 27A is formed from an Ni alloy, which will be described below. The inner layer 27B is formed from a metal, such as copper, a copper alloy, or pure Ni, higher in thermal conductivity than the aforementioned Ni alloy. In the present embodiment, the ground electrode 27 has the 2-layer structure consisting of the outer layer 27A and the inner layer 27B. The ground electrode 27 may have a 3-layer structure such that a core of Ni is further embedded in the inner layer 27B. Also, the ground electrode 27 satisfies the relational expression of the ratio between L and S (L/S) $1.5 \leq L/S \leq 8.5$, where L (m) is the distance from a proximal end portion (the other end portion) joined to the forward end surface of the metallic shell 3 to a distal end portion (one end portion) as measured along the extending direction of the ground electrode 27, and S ($mm^2$) is the area of a cross section of the ground electrode 27 taken perpendicularly to the extending direction.

Figure 2:
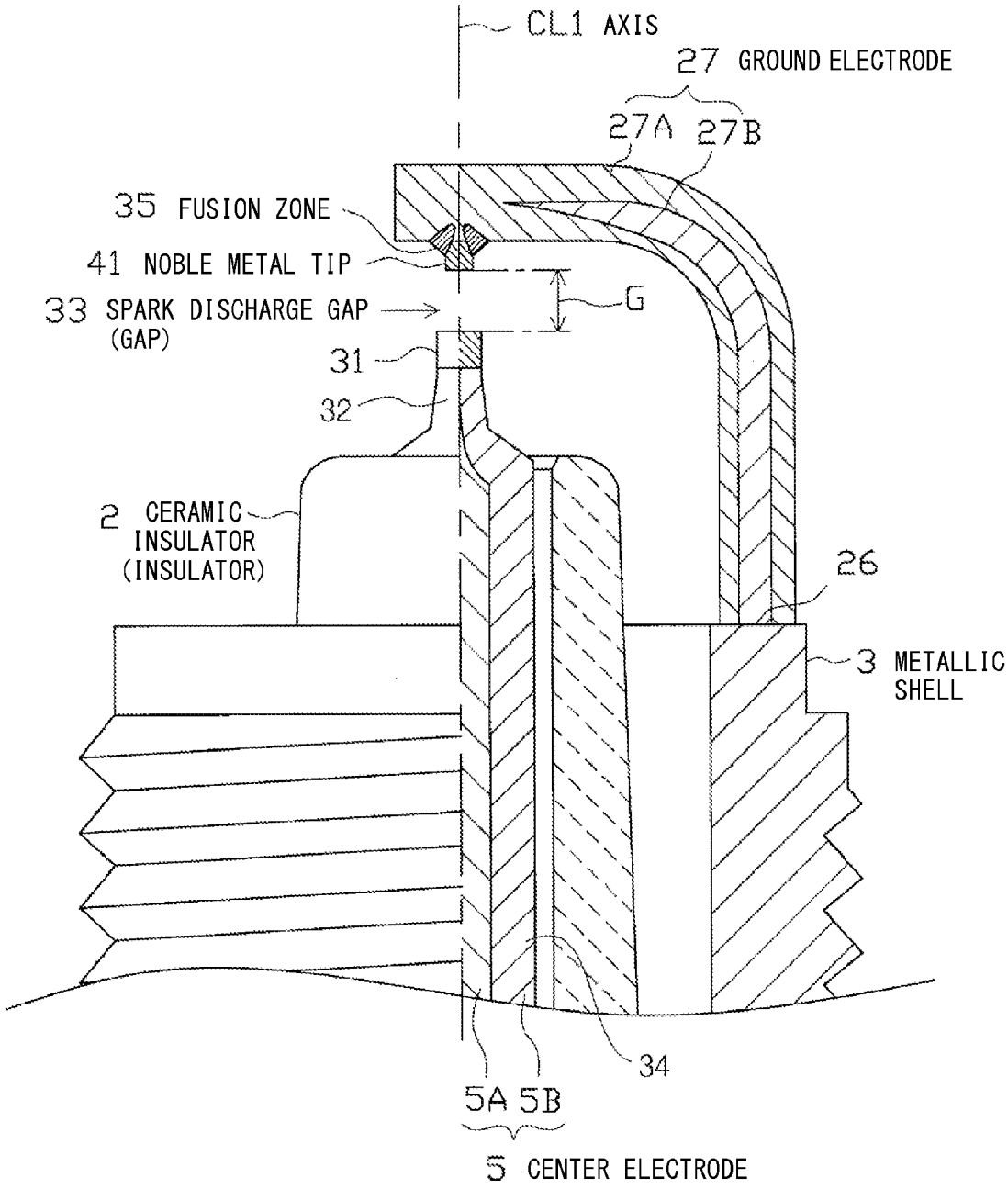
FIG. 2 is a partially-cutaway, enlarged, front view showing the configuration of a forward end portion of the spark plug.

Additionally, the ground electrode 27 has a circular columnar noble metal tip (spark member) 41 joined to a region thereof which faces the forward end surface of the noble metal member 31, and formed from platinum (Pt), iridium (Ir), ruthenium (Ru), or rhodium (Rh), or an alloy which contains any one of these elements as a main component. More specifically, as shown in FIG. 2, the noble metal tip 41 is joined to the ground electrode 27 such that a fusion zone 35 where the noble metal tip 41 and the ground electrode 27 are fused together is formed around a proximal end portion of the noble metal tip 41 by laser welding. The weight of the noble metal tip 41 is specified as 1.5 mg or more.

A spark discharge gap 33, which corresponds to the gap in the present invention, is formed between the noble metal member 31 and the noble metal tip 41. Spark discharges are performed across the spark discharge gap 33 substantially along the direction of the axis CL1. The spark discharge gap 33 has a gap G of 1.1 mm or less along the axis CL1.

The weight of the spark member (the noble metal member 31 or the noble metal tip 41) can be measured in the following manner. The center electrode 5 or the ground electrode 27 is cut in such a manner that a cut piece includes the spark member (the noble metal member 31 or the noble metal tip 41). Next, the cut piece is immersed in 35% hydrochloric acid or aqua regia so as to take out only the spark member through dissolution of only the portion of the center electrode 5 or the ground electrode 27. The weight of the thus-obtained spark member is then measured.

Next, an electrode material used to form the outer layer 5B of the center electrode 5 and the outer layer 27A of the ground electrode 27 will be described in detail.

The outer layer 5B of the center electrode 5 and the outer layer 27A of the ground electrode 27 contain Ni as a main component, C in an amount of 0.005% by mass to 0.1% by mass, Si in an amount of 1.05% by mass to 3% by mass, Mn in an amount of 2% by mass or less, Cr in an amount of 20% by mass to 32% by mass, and Fe in an amount of 6% by mass to 16% by mass.

Also, the outer layer 5B of the center electrode 5 and the outer layer 27A of the ground electrode 27 may contain at least one of Zr, Y, and REM in a total amount of 0.01% by mass to 0.5% by mass.

Furthermore, the outer layer 5B of the center electrode 5 and the outer layer 27A of the ground electrode 27 may contain Al in an amount of 0.1% by mass to 2% by mass.

Also, the outer layer 5B of the center electrode 5 and the outer layer 27A of the ground electrode 27 may contain at least one of Ti, Nb, and Cu in a total amount of 0.1% by mass to 2% by mass.

As described above in detail, the present embodiment can improve resistance to high-temperature oxidation of the center electrode 5 and the ground electrode 27 and can improve resistance to spark-induced erosion of, resistance to oxidation of, and joining reliability of the spark members (the noble meta member 31 and the noble metal tip 41) joined to the center electrode 5 and the ground electrode 27, respectively.

Next, there will be described various tests which were conducted to verify actions and effects of the present invention.

Evaluation Test 1

The components shown in Table 1 were compounded to form material powders. The material powders were then melted in a vacuum high-frequency induction furnace, thereby yielding ingots of individual compositions, 100 g each. The compositions shown in Table 1 were measured by analyzing the obtained ingots by a fluorescent X-ray analyzer and were shown such that the total of the components of each composition became 100% by mass. Next, the ingots of the compositions were hot-forged into circular columnar rods each having a diameter of 16 mm, and the rods were subjected to solution heat treatment at 1,100° C. Subsequently, the rods of the compositions were rolled into test pieces, each measuring 3 mm width×25 mm length×1.5 mm thickness, and the test pieces were annealed at 980° C. The annealed test pieces were evaluated for resistance to high-temperature oxidation.

Resistance to high-temperature oxidation was evaluated as follows. The test pieces were subjected to a heating and cooling test; specifically, 200 heating and cooling cycles, each cycle consisting of heating at 1,200° C. for 30 minutes in an electric furnace of the atmosphere and rapid cooling to the room temperature by a fan on the outside of the electric furnace. After the heating and cooling test, the cross sections of the test pieces were observed, and the maximum thickness (hereinafter referred to as the "residual thickness") of a non-oxidized region was measured. The percentage of the residual thickness to the thickness of a test piece before the heating and cooling test (residual percentage) was calculated. The calculation results are also shown in Table 1.

TABLE 1

| Sample No. | Ni | C (% by mass) | Si (% by mass) | Mn (% by mass) | Cr (% by mass) | Fe (% by mass) | Resistance to high-temperature oxidation Residual percentage (%) | Evaluation |
|---|---|---|---|---|---|---|---|---|
| 1 | Balance | 0.004 | 1.2 | 0.5 | 25 | 10 | 68.5 | Poor |
| 2 | Balance | 0.005 | 1.2 | 0.5 | 25 | 10 | 70.2 | Good |
| 3 | Balance | 0.01 | 1.2 | 0.5 | 25 | 10 | 78.1 | Good |
| 4 | Balance | 0.03 | 1.2 | 0.5 | 25 | 10 | 79.8 | Good |
| 5 | Balance | 0.06 | 1.2 | 0.5 | 25 | 10 | 77.0 | Good |
| 6 | Balance | 0.09 | 1.2 | 0.5 | 25 | 10 | 71.8 | Good |
| 7 | Balance | 0.1 | 1.2 | 0.5 | 25 | 10 | 71.3 | Good |
| 8 | Balance | 0.105 | 1.2 | 0.5 | 25 | 10 | 69.1 | Poor |
| 9 | Balance | 0.11 | 1.2 | 0.5 | 25 | 10 | 65.8 | Poor |
| 10 | Balance | 0.03 | 0.9 | 0.5 | 25 | 10 | 65.1 | Poor |
| 11 | Balance | 0.03 | 1 | 0.5 | 25 | 10 | 68.9 | Poor |
| 12 | Balance | 0.03 | 1.05 | 0.5 | 25 | 10 | 72.3 | Good |
| 13 | Balance | 0.03 | 2 | 0.5 | 25 | 10 | 77.6 | Good |
| 14 | Balance | 0.03 | 2.5 | 0.5 | 25 | 10 | 73.7 | Good |
| 15 | Balance | 0.03 | 3 | 0.5 | 25 | 10 | 72.0 | Good |
| 16 | Balance | 0.03 | 3.5 | 0.5 | 25 | 10 | 67.9 | Poor |
| 17 | Balance | 0.03 | 1.2 | 0 | 25 | 10 | 70.2 | Good |
| 18 | Balance | 0.03 | 1.2 | 0.05 | 25 | 10 | 70.6 | Good |
| 19 | Balance | 0.03 | 1.2 | 0.1 | 25 | 10 | 76.8 | Good |
| 20 | Balance | 0.03 | 1.2 | 1.3 | 25 | 10 | 73.1 | Good |
| 21 | Balance | 0.03 | 1.2 | 2 | 25 | 10 | 70.2 | Good |
| 22 | Balance | 0.03 | 1.2 | 2.5 | 25 | 10 | 68.9 | Poor |
| 23 | Balance | 0.03 | 1.2 | 0.5 | 19.4 | 10 | 62.2 | Poor |
| 24 | Balance | 0.03 | 1.2 | 0.5 | 20 | 10 | 70.6 | Good |
| 25 | Balance | 0.03 | 1.2 | 0.5 | 23 | 10 | 77.7 | Good |
| 26 | Balance | 0.03 | 1.2 | 0.5 | 28 | 10 | 76.4 | Good |
| 27 | Balance | 0.03 | 1.2 | 0.5 | 32 | 10 | 73.2 | Good |
| 28 | Balance | 0.03 | 1.2 | 0.5 | 32.5 | 10 | 69.3 | Poor |
| 29 | Balance | 0.03 | 1.2 | 0.5 | 25 | 5.4 | 67.4 | Poor |
| 30 | Balance | 0.03 | 1.2 | 0.5 | 25 | 6 | 74.7 | Good |

TABLE 1-continued

| Sample No. | Ni | C (% by mass) | Si (% by mass) | Mn (% by mass) | Cr (% by mass) | Fe (% by mass) | Resistance to high-temperature oxidation Residual percentage (%) | Evaluation |
|---|---|---|---|---|---|---|---|---|
| 31 | Balance | 0.03 | 1.2 | 0.5 | 25 | 12 | 88.1 | Good |
| 32 | Balance | 0.03 | 1.2 | 0.5 | 25 | 16 | 75.1 | Good |
| 33 | Balance | 0.03 | 1.2 | 0.5 | 25 | 16.5 | 69.0 | Poor |

As shown Table 1, sample Nos. 2-7, 12-15, 17-21, 24-27, and 30-32, which fall within the scope of the present invention, exhibit a residual percentage of 70% or more in evaluation of resistance to high-temperature oxidation, indicating that the samples have excellent resistance to high-temperature oxidation. By contrast, sample Nos. 1, 8-11, 16, 22, 23, 28, 29, and 33 exhibit a residual percentage of less than 70%, indicating that the samples are inferior in resistance to high-temperature oxidation.

Evaluation Test 2

Similar to evaluation test 1, rods of the compositions shown in Table 2 were rolled and then annealed at 980° C., thereby yielding strips of the compositions, each measuring 3 mm width×25 mm length×1.5 mm thickness. Next, Pt-based noble metal tips (Pt-20% by mass Ni) which had a diameter of 0.7 mm and differed in weight were resistance-welded to the respective strips, and Ir-based noble metal tips (Ir-20% by mass Rh) which had a thickness of 0.55 mm and differed in weight were laser-welded to the respective strips, thereby preparing test pieces. The weight of the Pt-based noble metal tips was varied by adjusting the thickness of the Pt-based noble metal tips to 0.2 mm (weight 1.3 mg), 0.23 mm (weight 1.5 mg), and 0.47 mm (weight 3.0 mg). The weight of the Ir-based noble metal tips was varied by adjusting the diameter of the Ir-based noble metal tips to 0.4 mm (weight 1.3 mg), 0.43 mm (weight 1.5 mg), and 0.6 mm (weight 3.0 mg). The test pieces were evaluated for joining reliability.

Joining reliability was evaluated as follows. The test pieces were subjected to a heating and cooling test; specifically, 20,000 heating and cooling cycles, each cycle consisting of heating by a burner at 1,100° C. for two minutes in the atmosphere and cooling for one minute by turning off the burner. After the heating and cooling test, the cross sections of the weld zones of the test pieces were observed, and, as viewed along the weld interface, the percentage of the length of a separated region to the length of the originally joined region (separation percentage) was calculated. The calculation results are also shown in Table 2.

TABLE 2

| Sample No. | Ni | C (% by mass) | Si (% by mass) | Mn (% by mass) | Cr (% by mass) | Fe (% by mass) | Separation percentage (%) Noble metal tip weight 1.3 mg | 1.5 mg | 3 mg | Noble metal tip type |
|---|---|---|---|---|---|---|---|---|---|---|
| 34 | Balance | 0.02 | 1.05 | 0.6 | 25.1 | 7.4 | Poor 32 | Good 22 | Good 2 | Ir—20Rh |
| 35 | Balance | 0.03 | 1.2 | 0.8 | 25.0 | 7.4 | Poor 33 | Good 25 | Good 7 | Pt—20Ni |
| 36 | Balance | 0.01 | 1.9 | 0.7 | 24.9 | 7.3 | Poor 40 | Good 26 | Good 11 | Ir—20Rh |
| 37 | Balance | 0.02 | 2.4 | 0.8 | 25 | 7.5 | Poor 47 | Good 28 | Good 21 | Pt—20Ni |
| 38 | Balance | 0.02 | 3 | 0.7 | 25.3 | 7.2 | Poor 50 | Good 30 | Good 27 | Pt—20Ni |
| 39 | Balance | 0.03 | 3.2 | 0.8 | 25.4 | 7.2 | Poor Lost | Poor 35 | Poor 32 | Ir—20Rh |
| 40 | Balance | 0.02 | 3.7 | 0.6 | 25 | 7.3 | Poor Lost | Poor Lost | Poor 43 | Pt—20Ni |

As shown in Table 2, among sample Nos. 34-38, whose compositions of the strips fall within the scope of the present invention, those having a noble metal tip weight of 1.5 mg or more exhibit a separation percentage of 30% or less, indicating the samples have high joining reliability. By contrast, even among sample Nos. 34-38, whose compositions of the strips fall within the scope of the present invention, those having a noble metal tip weight of less than 1.5 mg exhibit a separation percentage in excess of 30% or loss of the noble metal tip, indicating that the samples are inferior in joining reliability. That is, in a spark plug having a noble metal tip, in order to ensure resistance to high-temperature oxidation of the electrode and joining reliability of the noble metal tip, not only must the electrode have a required composition, but also the noble metal tip must have a weight of 1.5 mg or more.

Evaluation Test 3

Similar to evaluation test 1, rods of the compositions shown in Table 3 were rolled and then annealed at 980° C., thereby yielding round bars having a diameter of 0.75 mm and a length of 50 mm. Two pieces of each of the compositions were prepared. Next, a noble metal tip of Ir-20% by mass Rh having a diameter of 0.7 mm and a thickness of 0.6 mm was laser-welded to the end surface of one of two round bars of each of the compositions, and a noble metal tip of Pt-20% by mass Ni having a diameter of 0.7 mm and a thickness of 0.47 mm was laser-welded to the end surface of the other one of the two round bars. Next, the round bars which had the respective compositions and to which respective noble metal tips were joined, were subjected to a heating and cooling test; specifically, 20,000 heating and cooling cycles, each cycle consisting of heating by a burner at 1,100° C. for two minutes in the atmosphere and cooling for one minute by turning off the burner. After the heating and cooling test, the round bars of the compositions were disposed such that the noble metal tips face each other, followed by evaluation of spark-induced erosion.

Spark-induced erosion was evaluated as follows. Two round bars of the same composition were disposed in a nitrogen atmosphere of 0.7 MPa such that a gap of 0.9 mm was formed between two noble metal tips, and were then subjected to a discharge test in which a voltage of 20 kV was applied thereto at a frequency of 60 Hz for 50 hours. The discharge test was conducted under the following condition: a round bar to which a noble metal tip of Ir-20% by mass Rh was joined served as a negative pole, and a round bar to which a noble metal tip of Pt-20% by mass Ni was joined served as a positive pole. After the discharge test, the volumes of the two noble metal tips were measured by use of an X-ray CT apparatus. From the volumes of the two noble metal tips as measured before and after the discharge test, the total of reduced amounts of volumes of the two noble metal tips (spark-induced erosion) was calculated. The calculation results are also shown in Table 3.

TABLE 3

| Sample No. | Ni | C (% by mass) | Si (% by mass) | Mn (% by mass) | Cr (% by mass) | Fe (% by mass) | Spark-induced erosion ($mm^3$) |
|---|---|---|---|---|---|---|---|
| 41 | Balance | 0.02 | 1.05 | 0.6 | 25.1 | 7.4 | Good 14 |
| 42 | Balance | 0.03 | 1.2 | 0.8 | 25 | 7.4 | Good 17 |
| 43 | Balance | 0.03 | 1.4 | 0.8 | 25.2 | 7.3 | Good 23 |
| 44 | Balance | 0.02 | 1.5 | 0.7 | 24.8 | 7.5 | Fair 30 |

As shown in Table 3, sample Nos. 41-43, which have an Si content of 1.4% by mass or less, exhibit a spark-induced erosion of 30 $mm^3$ or less, indicating the samples have good resistance to spark-induced erosion. By contrast, sample No. 44 exhibits a spark-induced erosion in excess of 30 $mm^3$, indicating the sample is inferior in resistance to spark-induced erosion.

Evaluation Test 4

Similar to evaluation test 1, rods of the compositions (which contain Zr, Y, and REM singly or in combination) shown in Table 4 were rolled into test pieces, each measuring 3 mm width×25 mm length×1.5 mm thickness, and then the test pieces were annealed at 980° C. The annealed test pieces were evaluated for resistance to high-temperature oxidation as in the case of evaluation test 1. Also, in order to evaluate workability, the surfaces of the prepared test pieces were observed for cracking. The results are shown in Table 4.

TABLE 4

| Sample No. | Ni | C (% by mass) | Si (% by mass) | Mn (% by mass) | Cr (% by mass) | Fe (% by mass) | Zr (% by mass) | Y (% by mass) | REM (% by mass) | Resistance to high-temperature oxidation Residual percentage (%) | Workability | Evaluation |
|---|---|---|---|---|---|---|---|---|---|---|---|---|
| 45 | Balance | 0.03 | 1.2 | 0.5 | 25 | 10 | 0.01 | | | 85.2 | No crack | Good |
| 46 | Balance | 0.03 | 1.2 | 0.5 | 25 | 10 | | 0.01 | | 85.4 | No crack | Good |
| 47 | Balance | 0.03 | 1.2 | 0.5 | 25 | 10 | | | 0.01(Ce) | 80.3 | No crack | Good |
| 48 | Balance | 0.03 | 1.2 | 0.5 | 25 | 10 | | 0.05 | | 85.9 | No crack | Good |
| 49 | Balance | 0.03 | 1.2 | 0.5 | 25 | 10 | | 0.1 | | 86.1 | No crack | Good |
| 50 | Balance | 0.03 | 1.2 | 0.5 | 25 | 10 | | 0.15 | | 86.4 | No crack | Good |
| 51 | Balance | 0.03 | 1.2 | 0.5 | 25 | 10 | 0.2 | | | 87.6 | No crack | Good |
| 52 | Balance | 0.03 | 1.2 | 0.5 | 25 | 10 | | | 0.25(Nd) | 81.0 | No crack | Good |
| 53 | Balance | 0.03 | 1.2 | 0.5 | 25 | 10 | | 0.3 | | 80.1 | No crack | Good |
| 54 | Balance | 0.03 | 1.2 | 0.5 | 25 | 10 | | | 0.45(Ce) | 80.6 | No crack | Good |
| 55 | Balance | 0.03 | 1.2 | 0.5 | 25 | 10 | 0.5 | | | 80.9 | No crack | Good |
| 56 | Balance | 0.03 | 1.2 | 0.5 | 25 | 10 | | 0.5 | | 81.1 | No crack | Good |
| 57 | Balance | 0.03 | 1.2 | 0.5 | 25 | 10 | | | 0.5(Nd) | 80.7 | No crack | Good |
| 58 | Balance | 0.03 | 1.2 | 0.5 | 25 | 10 | 0.51 | | | 80.0 | Cracked | Fair |
| 59 | Balance | 0.03 | 1.2 | 0.5 | 25 | 10 | 0.01 | 0.01 | 0.01(Ce) | 80.1 | No crack | Good |
| 60 | Balance | 0.03 | 1.2 | 0.5 | 25 | 10 | 0.1 | 0.2 | 0.05(Nd) | 80.3 | No crack | Good |

As shown in Table 4, sample Nos. 45-57, 59, and 60, whose total contents of Zr, Y, and REM are 0.01% by mass to 0.5% by mass, exhibit a residual percentage of 80% or more in evaluation of resistance to high-temperature oxidation, indicating that the samples have quite excellent resistance to high-temperature oxidation, and also the samples exhibit good workability. By contrast, sample No. 58 exhibits a residual percentage of 80% or more, but exhibits poor workability.

Evaluation Test 5

Similar to evaluation test 1, rods of the compositions (which contain Al) shown in Table 5 were rolled and then annealed at 980° C., thereby yielding test pieces, each measuring 3 mm width×25 mm length×1.5 mm thickness. The test pieces were then evaluated for resistance to high-temperature oxidation as in the case of evaluation test 1 and were also evaluated for resistance to high-temperature nitridation.

Resistance to high-temperature nitridation was evaluated as follows. The test pieces were subjected to a heating and cooling test; specifically, 20,000 heating and cooling cycles, each cycle consisting of heating by a burner at 1,100° C. for two minutes in the atmosphere and cooling for one minute by turning off the burner. After the heating and cooling test, the cross sections of the test pieces were observed, and the maximum thickness (hereinafter referred to as the "residual thickness") of a non-oxidized r non-nitrided region was measured. The percentage of the residual thickness to the thickness of a test piece before the heating and cooling test (residual percentage) was calculated. The calculation results are also shown in Table 5.

TABLE 5

| No. | Ni | C (% by mass) | Si (% by mass) | Mn (% by mass) | Cr (% by mass) | Fe (% by mass) | Zr (% by mass) | Y (% by mass) | REM (% by mass) | Al (% by mass) | Resistance to high-temp. oxidation Residual p.c. (%) | Resistance to high-temp. nitridation Residual p.c. (%) | Evaluation |
|---|---|---|---|---|---|---|---|---|---|---|---|---|---|
| 61 | Balance | 0.03 | 1.2 | 0.5 | 25 | 10 | | | | 0.1 | 83.5 | 89.9 | Good |
| 62 | Balance | 0.03 | 0.1 | 0.5 | 25 | 10 | | | | 0.7 | 53.8 | 72.6 | Poor |
| 63 | Balance | 0.03 | 1.2 | 0.5 | 25 | 10 | | | | 0.7 | 85.2 | 92.4 | Good |
| 64 | Balance | 0.03 | 1.2 | 0.5 | 25 | 10 | | 0.2 | | 0.7 | 87.1 | 96.7 | Good |
| 65 | Balance | 0.03 | 1.2 | 0.5 | 25 | 10 | | | | 1.2 | 86.0 | 96.1 | Good |
| 66 | Balance | 0.03 | 1.2 | 0.5 | 25 | 10 | | 0.1 | | 1.2 | 87.7 | 97.0 | Good |
| 67 | Balance | 0.03 | 1.2 | 0.5 | 25 | 10 | | | | 1.6 | 84.1 | 93.3 | Good |
| 68 | Balance | 0.03 | 1.2 | 0.5 | 25 | 10 | | | | 2 | 83.9 | 90.2 | Good |
| 69 | Balance | 0.03 | 1.2 | 0.5 | 25 | 10 | | | | 2.1 | 81.0 | 88.9 | Fair |

As shown in Table 5, sample Nos. 61 and 63-68, which fall within the scope of the present invention and whose Al contents are 0.1% by mass to 2% by mass, exhibit a residual percentage of 83% or more in evaluation of resistance to high-temperature oxidation and a residual percentage of 90% or more in evaluation of resistance to high-temperature nitridation, indicating that the samples are superior in resistance to high-temperature oxidation and resistance to high-temperature nitridation. By contrast, sample No. 62, whose composition fails to fall within the scope of the present invention except that Al is contained, has been found to be inferior in resistance to high-temperature oxidation and resistance to high-temperature nitridation. Sample No. 69 exhibits a residual percentage of less than 90% in evaluation of resistance to high-temperature nitridation, indicating that the sample is inferior in resistance to high-temperature nitridation.

Evaluation Test 6

Similar to evaluation test 1, rods of the compositions (which contain Ti, Nb, and Cu singly or in combination) shown in Table 6 were rolled and then annealed at 980° C., thereby yielding test pieces, each measuring 3 mm width×25 mm length×1.5 mm thickness. The test pieces were then evaluated for resistance to high-temperature oxidation as in the case of evaluation test 1. Also, in order to evaluate workability, the surfaces of the prepared test pieces were observed for cracking. The results are shown in Table 6.

TABLE 6

| Sample No. | Ni | C (% by mass) | Si (% by mass) | Mn (% by mass) | Cr (% by mass) | Fe (% by mass) | Zr (% by mass) | Y (% by mass) | REM (% by mass) | Al (% by mass) | Ti (% by mass) | Nb (% by mass) | Cu (% by mass) | Resistance to high-temp. oxidation Residual p.c. (%) | Workability | Evaluation |
|---|---|---|---|---|---|---|---|---|---|---|---|---|---|---|---|---|
| 70 | Balance | 0.03 | 1.2 | 0.5 | 25 | 10 | | | | | 0.05 | | | 85.3 | No crack | Good |
| 71 | Balance | 0.03 | 1.2 | 0.5 | 25 | 10 | | | | | 0.1 | | | 86.5 | No crack | Good |
| 72 | Balance | 0.03 | 1.2 | 0.5 | 25 | 10 | | | | | 0.3 | | | 87.0 | No crack | Good |
| 73 | Balance | 0.03 | 1.2 | 0.5 | 25 | 10 | | | | 0.7 | 0.3 | | | 88.6 | No crack | Good |
| 74 | Balance | 0.03 | 1.2 | 0.5 | 25 | 10 | | | | | 0.7 | | | 85.4 | No crack | Good |
| 75 | Balance | 0.03 | 1.2 | 0.5 | 25 | 10 | | | | | 1.1 | | | 85.0 | Cracked | Fair |
| 76 | Balance | 0.03 | 1.2 | 0.5 | 25 | 10 | | | | | | 0.7 | | 85.4 | No crack | Good |
| 77 | Balance | 0.03 | 1.2 | 0.5 | 25 | 10 | | | | | | 0.8 | | 86.6 | No crack | Good |
| 78 | Balance | 0.03 | 1.2 | 0.5 | 25 | 10 | | | | 0.7 | | 0.8 | | 87.9 | No crack | Good |
| 79 | Balance | 0.03 | 1.2 | 0.5 | 25 | 10 | | | | | | 1.5 | | 86.6 | No crack | Good |
| 80 | Balance | 0.03 | 1.2 | 0.5 | 25 | 10 | | | | | | 2.1 | | 86.0 | Cracked | Fair |
| 81 | Balance | 0.03 | 1.2 | 0.5 | 25 | 10 | | | | | | | 0.1 | 86.9 | No crack | Good |
| 82 | Balance | 0.03 | 1.2 | 0.5 | 25 | 10 | | | | | | | 0.7 | 87.2 | No crack | Good |
| 83 | Balance | 0.03 | 1.2 | 0.5 | 25 | 10 | | | | 0.7 | | | 0.7 | 88.5 | No crack | Good |
| 84 | Balance | 0.03 | 1.2 | 0.5 | 25 | 10 | | | | | | | 1.4 | 87.0 | No crack | Good |
| 85 | Balance | 0.03 | 1.2 | 0.5 | 25 | 10 | | | | | | | 2.1 | 86.3 | No crack | Good |

As shown in Table 6, sample Nos. 70-74, 76-79, and 81-85, whose total content of Ti, Nb, and Cu is 0.1% by mass to 2% by mass, exhibit a residual percentage of 85% or more in evaluation of resistance to high-temperature oxidation, indicating that the samples have quite excellent resistance to high-temperature oxidation. These samples also exhibit good workability. By contrast, sample Nos. 75 and 80 exhibit a residual percentage of 85% or more, but exhibit poor workability.

Evaluation Test 7

Similar to evaluation test 1, rods of the compositions shown in Table 7 were rolled and then annealed at 980° C., thereby yielding ground electrodes. The sizes of the ground electrodes are shown in Table 8. Next, the ground electrodes were resistance-welded to the forward end surfaces of respective metallic shells, thereby yielding test samples. The ground electrodes of the test samples were evaluated for resistance to breakage.

Resistance to breakage was evaluated as follows. The test samples were subjected to a heating and cooling test; specifically, 10,000 heating and cooling cycles, each cycle consisting of heating by a burner for two minutes in the atmosphere and cooling for one minute by turning off the burner. The heating temperature was as follows: heating power of the burner was adjusted such that the ground electrode of the test sample having sample No. 89 and an L/S of 4.6 in Table 7 had a temperature of 1,000° C., and other test samples were heated with the same heating power of the burner. In order to prevent overheating of the metallic shell, the heating and cooling test was conducted while the metallic shell was fixed to a water-cooled (water temperature 40° C.) aluminum holder. After the heating and cooling test, the test samples were subjected to a tensile test (crosshead speed 15 mm/min) conducted such that while the metallic shell of each of the test samples was fixed, one end of the ground electrode was gripped, and the areas of fracture cross sections were measured. The percentage of the area of the fracture cross section to the cross-sectional area of the ground electrode before the heating and cooling test (cross-sectional area percentage) was calculated. The calculation results are also shown in Table 7.

TABLE 8

| Width (mm) | Thickness (mm) | Cross-sectional area S ($mm^2$) | Length L (mm) | L/S |
|---|---|---|---|---|
| 2.7 | 1.3 | 3.51 | 5 | 1.4 |
| 2.5 | 1.6 | 4 | 6 | 1.5 |
| 2.5 | 1.3 | 3.25 | 8 | 2.5 |
| 2.7 | 1.3 | 3.51 | 13 | 3.7 |
| 2.7 | 1.3 | 3.51 | 16 | 4.6 |
| 2.7 | 1.3 | 3.51 | 20 | 5.7 |
| 2 | 1 | 2 | 13 | 6.5 |
| 2 | 1 | 2 | 15 | 7.5 |
| 2 | 1 | 2 | 17 | 8.5 |
| 1.5 | 1 | 1.5 | 13 | 8.7 |

As shown in Table 7, the test samples whose electrode compositions fall within the scope of the present invention and whose ratios between L and S (L/S) satisfy the relational expression $1.5 \leq L/S \leq 8.5$ exhibit a cross-sectional area percentage of 70% or less, indicating that the test samples are superior in resistance to breakage. Particularly, among the test sample, those whose ratios between L and S (L/S) satisfy the relational expression $3.7 \leq L/S \leq 5.7$ are more superior in resistance to breakage. By contrast, the test samples whose ratios between L and S (L/S) are less than 1.5 or in excess of 8.5 exhibit a cross-sectional area percentage in excess of 70%, indicating that the test samples are inferior in resistance to breakage.

Evaluation Test 8

Similar to evaluation test 1, center electrodes having the compositions shown in Table 9 were prepared. Each of the center electrodes has a conical portion at its distal end, and the distal end surface of the conical portion has a diameter of 1.0 mm, while the proximal end (the boundary between the conical portion and the body portion of the center electrode) of the conical portion has a diameter of 2.0 mm. As shown in Table 9, the center electrodes were prepared so as to differ in the volume of the conical portion. The volume of the conical portion was varied through adjustment of the axial length of the conical portion. Next, noble metal tips (weight 4.4 mg) of Ir-10% by mass Rh, each having a diameter of 0.6 mm and a

TABLE 7

| Sample No. | Ni | C (% by mass) | Si (% by mass) | Mn (% by mass) | Cr (% by mass) | Fe (% by mass) | Y (% by mass) | Al (% by mass) | Cross-sectional area percentage (%) L/S 1.4 | 1.5 | 2.5 | 3.7 | 4.6 | 5.7 | 6.5 | 7.5 | 8.5 | 8.7 |
|---|---|---|---|---|---|---|---|---|---|---|---|---|---|---|---|---|---|---|
| 86 | Balance | 0.02 | 1.2 | 0.7 | 25.2 | 7.4 | | | PP | BB | BB | AA | AA | AA | BB | BB | BB | PP |
| | | | | | | | | | 71 | 68 | 68 | 58 | 56 | 58 | 63 | 66 | 69 | 77 |
| 87 | Balance | 0.01 | 2.4 | 0.8 | 25.1 | 7.5 | | | PP | BB | BB | AA | AA | AA | BB | BB | BB | PP |
| | | | | | | | | | 72 | 69 | 68 | 58 | 58 | 60 | 65 | 68 | 69 | 80 |
| 88 | Balance | 0.02 | 1.2 | 0.3 | 26.5 | 10 | 0.15 | 0.8 | PP | BB | BB | AA | AA | AA | BB | BB | BB | PP |
| | | | | | | | | | 71 | 68 | 66 | 55 | 53 | 56 | 61 | 66 | 66 | 71 |
| 89 | Balance | 0.01 | 2.4 | 0.2 | 26.4 | 9.9 | 0.14 | 0.7 | PP | BB | BB | AA | AA | AA | BB | BB | BB | PP |
| | | | | | | | | | 72 | 68 | 67 | 56 | 55 | 58 | 63 | 67 | 68 | 74 |
| 90 | Balance | 0.03 | 0.21 | 0.3 | 22 | 14.6 | | 1.5 | PP | PP | PP | PP | PP | PP | PP | PP | — | — |
| | | | | | | | | | 80 | 78 | 77 | 82 | 87 | 93 | 97 | 97 | | |
| 91 | Balance | 0.04 | 0.2 | 0.2 | 16 | 8.5 | | 0.2 | PP | PP | PP | PP | PP | PP | PP | — | — | — |
| | | | | | | | | | 86 | 84 | 83 | 88 | 92 | 97 | 97 | | | |
| 92 | Balance | 0.02 | 3.7 | 0.3 | 26.6 | 9.9 | | | PP | PP | PP | PP | PP | PP | PP | PP | — | — |
| | | | | | | | | | 82 | 81 | 82 | 82 | 84 | 90 | 95 | 98 | | |
| 93 | Balance | 0.01 | 3.7 | 0.2 | 26.5 | 9.8 | 0.17 | 0.7 | PP | PP | PP | PP | PP | PP | PP | PP | PP | — |
| | | | | | | | | | 81 | 77 | 76 | 80 | 81 | 83 | 87 | 94 | 97 | |

AA: Excellent;
BB: Good;
PP: Poor thickness of 0.8 mm, were laser-welded to the distal end surfaces of the respective center electrodes. Subsequently, the center electrodes having the respective noble metal tips joined thereto underwent various assembling steps, such as assembling to the respective insulators, thereby yielding spark plugs. The thus-prepared spark plugs were evaluated for spark-induced erosion.

Spark-induced erosion was evaluated as follows. The spark plugs were subjected to an onboard test; specifically, the spark plugs were mounted to a 6-cylinder (displacement 2,800 cc) engine, and an operation cycle consisting of one-minute operation at a rotational speed of 5,500 rpm with full throttle opening and subsequent one-minute idling was repeated for 300 hours. After the onboard test was completed, the volumes of the noble metal tips of the spark plugs were measured. The percentage of the volume of the noble metal tip after the onboard test to the volume of the noble metal tip before the onboard test (residual percentage) was calculated. The calculation results are also shown in Table 9.

TABLE 9

| Sample No. | Ni | C (% by mass) | Si (% by mass) | Mn (% by mass) | Cr (% by mass) | Fe (% by mass) | Y (% by mass) | Al (% by mass) | Reduction percentage (%) Volume of conical portion ($mm^3$) 0.17 | 0.2 | 0.4 | 0.8 | 1.6 | 2.0 | 2.5 | 2.7 |
|---|---|---|---|---|---|---|---|---|---|---|---|---|---|---|---|---|
| 94 | Balance | 0.02 | 1.2 | 0.7 | 25.2 | 7.4 | | | Poor 74 | Good 59 | Good 51 | Good 46 | Good 52 | Good 56 | Good 61 | Poor 75 |
| 95 | Balance | 0.01 | 2.4 | 0.8 | 25.1 | 7.5 | | | Poor 78 | Good 61 | Good 53 | Good 50 | Good 58 | Good 55 | Good 63 | Poor 78 |
| 96 | Balance | 0.02 | 1.2 | 0.3 | 26.5 | 10 | 0.15 | 0.8 | Poor 72 | Good 57 | Good 49 | Good 43 | Good 50 | Good 52 | Good 58 | Poor 69 |
| 97 | Balance | 0.01 | 2.4 | 0.2 | 26.4 | 9.9 | 0.14 | 0.7 | Poor 77 | Good 59 | Good 50 | Good 48 | Good 56 | Good 55 | Good 60 | Poor 72 |
| 98 | Balance | 0.03 | 0.21 | 0.3 | 22 | 14.6 | | | Poor Lost | Poor 91 | Poor 83 | Poor 74 | Poor 68 | Poor 77 | Poor 86 | Poor Detached |
| 99 | Balance | 0.04 | 0.2 | 0.2 | 16 | 8.5 | | | Poor Lost | Poor Lost | Poor 89 | Poor 78 | Poor 75 | Poor 81 | Poor 89 | Poor Detached |
| 100 | Balance | 0.02 | 3.7 | 0.3 | 26.6 | 9.9 | | | Poor Lost | Poor 95 | Poor 87 | Poor 77 | Poor 71 | Poor 80 | Poor 90 | Poor Detached |
| 101 | Balance | 0.01 | 3.7 | 0.2 | 26.5 | 9.8 | 0.17 | 0.7 | Poor Lost | Poor 93 | Poor 84 | Poor 76 | Poor 70 | Poor 79 | Poor 88 | Poor Detached |

As shown in Table 9, the center electrodes whose electrode compositions fall within the scope of the present invention and whose conical portions have a volume of 0.2 $mm^3$ to 2.5 $mm^3$ exhibit a reduction percentage of 65% or less, indicating that the center electrodes are superior in resistance to spark-induced erosion. By contrast, the center electrodes whose conical portions have a volume of less than 0.2 $mm^3$ or a volume in excess of 2.5 $mm^3$ exhibit a reduction percentage in excess of 65%, indicating that the center electrodes are inferior in resistance to spark-induced erosion.

The present invention is not limited to the above-described embodiment, but may be embodied, for example, as follows. Of course, applications and modifications other than those exemplified below are also possible.

In the above-described embodiment, the noble metal tip 41 is joined to the ground electrode 27 by laser welding; however, the noble metal tip 41 and the ground electrode 27 may be joined together by resistance welding.

In the above-described embodiment, the noble metal tip 41 to be joined to the ground electrode 27 has a circular columnar shape; however, the shape of the noble metal tip 41 is not limited thereto, but may be a disk-like shape or a prismatic shape.

In the above-described embodiment, the ground electrode 27 has a 2-layer structure consisting of the outer layer 27A and the inner layer 27B; however, the inner layer 27B may be eliminated; i.e., the entire ground electrode may be formed from an Ni alloy.

The invention claimed is:

1. A spark plug comprising:

a center electrode extending in an axial direction;

a ceramic insulator surrounding a radial circumference of the center electrode;

a metallic shell surrounding a radial circumference of the ceramic insulator and holding the ceramic insulator; and a ground electrode which is bent such that one end portion thereof and a forward end portion of the center electrode form a gap therebetween and whose other end portion is joined to the metallic shell;

a small spark member which contains a noble metal as a main component being provided on at least one of the center electrode and the ground electrode at a position which faces the gap;

the spark plug being characterized in that:

the spark member has a weight of 1.5 mg or more, and the center electrode or the ground electrode on which the spark member is provided contains Ni as a main component, C in an amount of 0.005% by mass to 0.1% by mass, Si in an amount of 1.05% by mass to 3% by mass, Mn in an amount of 2% by mass or less, Cr in an amount of 20% by mass to 32% by mass, and Fe in an amount of 6% by mass to 16% by mass.

2. A spark plug according to claim 1, wherein the electrode on which the spark member is provided contains Si in an amount of 1.4% by mass or less.

3. A spark plug according to claim 1 or 2, wherein the electrode on which the spark member is provided contains at least one of Zr, Y, and REM in a total amount of 0.01% by mass to 0.5% by mass.

4. A spark plug according to claims 1 or 2, wherein the electrode on which the spark member is provided contains Al in an amount of 0.1% by mass to 2% by mass.

5. A spark plug according to claims 1 or 2, wherein the electrode on which the spark member is provided contains at least one of Ti, Nb, and Cu in a total amount of 0.1% by mass to 2% by mass.

6. A spark plug according to of claims 1 or 2, wherein:

the other end portion of the ground electrode is joined to a forward end surface of the metallic shell, and a relational expression $1.5 \leq L/S \leq 8.5$ is satisfied, where L is a length of the ground electrode as measured from the other end portion to the one end portion along an extending direction of the ground electrode, and S is an area of a cross section of the ground electrode taken perpendicularly to the extending direction.

7. A spark plug according to claims 1 or 2, wherein:

a conical portion is formed at the forward end portion of the center electrode;

the spark member is provided at a tip of the conical portion; and the conical portion of the center electrode has a volume of 0.2 $mm^3$ to 2.5 $mm^3$.

* * * * *